US008797252B2

(12) United States Patent
Nagano et al.

(10) Patent No.: US 8,797,252 B2
(45) Date of Patent: Aug. 5, 2014

(54) LIQUID CRYSTAL DISPLAY APPARATUS AND METHOD FOR GENERATING A DRIVER SIGNAL BASED ON RESISTANCE RATIOS

(71) Applicant: Mitsubishi Electric Corporation, Chiyoda-ku (JP)

(72) Inventors: Shingo Nagano, Kikuchi-gun (JP); Yuichi Masutani, Kikuchi-gun (JP); Hisaharu Oura, Kikichi-gun (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/920,547

(22) Filed: Jun. 18, 2013

(65) Prior Publication Data

US 2013/0278647 A1 Oct. 24, 2013

Related U.S. Application Data

(63) Continuation of application No. 11/061,532, filed on Feb. 18, 2005, now abandoned.

(30) Foreign Application Priority Data

Mar. 25, 2004 (JP) ..... 2004-089067

(51) Int. Cl.
*G09G 3/36* (2006.01)

(52) U.S. Cl.
USPC ..... 345/100

(58) Field of Classification Search
USPC ..... 345/96, 98–100, 208–211, 89
See application file for complete search history.

(56) References Cited

U.S. PATENT DOCUMENTS

| | | | |
|---|---|---|---|
| 5,434,599 | A | 7/1995 | Hirai et al. |
| 5,986,631 | A | 11/1999 | Nanno et al. |
| 6,407,728 | B1 | 6/2002 | Sekine |
| 6,583,839 | B2 | 6/2003 | Suzuki et al. |
| 6,980,190 | B2 | 12/2005 | Ueda |

(Continued)

FOREIGN PATENT DOCUMENTS

| | | | |
|---|---|---|---|
| JP | 8-254712 | A | 10/1996 |
| JP | 10-171422 | A | 6/1998 |

(Continued)

OTHER PUBLICATIONS

Japanese Language Communication dated Feb. 7, 2006.

(Continued)

*Primary Examiner* — Allison W Johnson
(74) *Attorney, Agent, or Firm* — Buchanan Ingersoll & Rooney PC

(57) ABSTRACT

A liquid crystal display apparatus according to the invention is an in-plane switching liquid crystal display apparatus having gate wirings and source wirings, which intersect one another, and also having pixel electrodes each connected to an associated one of the source wirings, and common electrodes disposed opposite to the pixel electrodes. A scanning signal is inputted to the gate wiring so that one horizontal period has a writing period, in which a pixel potential is written to the pixel electrode, and a nonwriting period, in which no pixel potential is written to the pixel electrode. The pixel potential is outputted to the source wiring in the writing period, while a common potential is inputted to the source wiring in the nonwriting period.

14 Claims, 8 Drawing Sheets

(56) References Cited

U.S. PATENT DOCUMENTS

| | | | | |
|---|---|---|---|---|
| 7,167,154 | B2 | 1/2007 | Sato et al. | |
| 7,196,683 | B2 | 3/2007 | Yamamoto et al. | |
| 7,321,353 | B2 | 1/2008 | Tsuda et al. | |
| 2003/0086044 | A1 | 5/2003 | Inoue et al. | |
| 2003/0156104 | A1* | 8/2003 | Morita | 345/204 |
| 2003/0184334 | A1 | 10/2003 | Matsunaga et al. | |
| 2003/0234800 | A1* | 12/2003 | Nakajima et al. | 345/690 |
| 2004/0119672 | A1 | 6/2004 | Lee et al. | |
| 2006/0279498 | A1* | 12/2006 | Kaneda et al. | 345/89 |

FOREIGN PATENT DOCUMENTS

| | | | |
|---|---|---|---|
| JP | 2000-010074 | A | 1/2000 |
| JP | 2000-147456 | A | 5/2000 |
| JP | 2003-075850 | A | 3/2003 |
| JP | 2003-207760 | A | 7/2003 |

OTHER PUBLICATIONS

M. Oh-E et al., "Principles and Characteristics of Electro-Optical Behaviour With In-Plane Switching Mode", Asia Display '95, 1995 (month unknown), pp. 577-580.

Nakajima, Yasushi. Liquid Crystal Display Device. Jan. 14, 2000. English Machine Translation of JP 2000-010074.

* cited by examiner

CONVENTIONAL ART

CONVENTIONAL ART

LIQUID CRYSTAL DISPLAY APPARATUS AND METHOD FOR GENERATING A DRIVER SIGNAL BASED ON RESISTANCE RATIOS

BACKGROUND OF THE INVENTION

1. Field of the Invention

The present invention relates to a liquid crystal apparatus and to a manufacturing method therefor. More particularly, the present invention relates to an in-plane switching liquid crystal display apparatus and to a manufacturing method therefor.

2. Description of the Related Art

In an active matrix liquid crystal display apparatus, an IPS (In Plane Switching) method, according to which the direction of an electric field to be applied to liquid crystals is set to be parallel to a substrate, is used mainly as a technique for obtaining an ultrawide viewing angle (see JP-A-8-254712). It has been revealed that the employment of this method almost eliminates change in contrast and inversion of a gradation level, both of which would occur when a viewing angle direction is changed (see M. Oh-e, et al.: Asia Display 95, pp. 577-580). FIG. 11A is a plan view showing a pixel portion of a conventional ordinary IPS liquid crystal display apparatus. Further, FIG. 11B is an enlarged view showing a part thereof. In these figures, reference numeral 100 designates a TFT array substrate, and numeral 200 denotes a color filer (CF) substrate. Further, numeral 1 designates a gate wiring that is a plurality of scanning-signal lines formed on an insulating substrate, numeral 2 denotes a gate insulating film, numeral 3 designates a source wiring, numeral 4 denotes an insulating film provided on the source wiring 3, and reference characters 5*a* and 5*b* designate common electrodes provided on a same layer as the gate wiring. Reference numeral 6 a pixel electrode disposed opposite to the common electrode. Especially, in this example, a common electrode 5 is placed by being split into the common electrode 5*a* and the common electrode 5*b*. Thus, in a sate in which a voltage is applied to the source wiring, an electric field E is generated due to the voltage and changes the orientation condition of liquid crystals provided between the TFT array substrate 100 and the CF substrate 200. Consequently, the portion of the configuration shown in FIGS. 11A and 11B needs a large width indicated by "L1" in the figure, so that the transmission of light therethrough is restricted. Therefore, this apparatus has a problem that the aperture rate thereof is low.

To solve such a problem, a structure shown in FIGS. 12A and 12B has been proposed. In this structure, a common electrode 5 covers a source wiring 3. Both the common electrode 5 and the source wiring 3 are disposed in such a way as to overlap with each other. With such a structure, an electric field generated from the source wiring 3 is shielded by the common electrode 5. Thus, the electric field does not reach the liquid crystal, so that the change in the orientation condition of the liquid crystal can be reduced. Consequently, the width L2 for restricting the transmission of light can be narrowed. The aperture rate can be enhanced.

In such an IPS liquid crystal display apparatus, an electric potential is generated in a direction being horizontal to the substrate due to a common electric potential $V_{com}$ at the common electrode 5 and an electric potential $V_s$ at the pixel electrode 6, as shown in FIG. 13. A desired image is displayed by driving the liquid crystals in the direction being horizontal to the substrate.

Usually, an active matrix liquid crystal display apparatus is employed as the IPS liquid crystal display apparatus. In the active matrix liquid crystal display apparatus, pixels shown in FIGS. 12A and 12B are disposed in a matrix manner. Therefore, plural gate wirings 1 and plural source wirings 3 are placed therein. Further, a TFT, which is a switching device, is disposed in the vicinity of each of intersections between the gate wirings 1 and the source wirings 3.

Scanning signals are supplied to each of the gate wirings in Such a way as to switch between ON/OFF modes of the TFT connected thereto. On the other hand, display signals for driving the liquid crystals are supplied to the source wirings. In a time period during which this TFT is turned on, the source wiring 3 and the pixel electrode are conducted to one another, so that a display signal is written to the pixel electrode. The common electrode disposed opposite to the pixel electrode is supplied with common electric potential. The liquid crystals are driven by a driving voltage generated between the pixel electrode and the common electrode according to this display signal. Among the plural gate wirings, the gate wirings, the TFT connected to each of which is turned on, are sequentially scanned from an end one thereof. Then, the display signals are sequentially supplied to the plural source wirings 3 in synchronization with the scanning of the gate wirings, the TFT of each of which is turned on. That is, display signals for the pixels are written thereto in a period during which the associated TFT is turned on.

A period of turning-on of TFTs connected to all the gate wirings is called a vertical period. Generally, the frequency in the vertical period is 60 Hz. That is, in a time period of (1/60) sec., the gate wirings are sequentially scanned from the Lop one to the bottom one thereof, so that the display signals are written to all the pixel electrodes. Therefore, the rewriting of the screen is performed 60 times per second. Furthermore, a period of turning-on of each of TFTs connected to the gate wirings is called a horizontal period. The frequency in the horizontal period is given by multiplying (the frequency of the vertical period) by (the number of the gate wirings). Therefore, generally, a write time assigned to one gate wiring 1 is given by dividing (1/60 sec.) by (the number of the gate wirings).

Next, the scanning signal inputted to the gate wiring, and the display signal inputted to the source wiring 3 are described by using FIG. 14. FIG. 14 is a timing chart schematically showing the scanning signal inputted to the gate wiring, and the display signal inputted to the source wiring. In FIG. 14, reference character G designates a scanning signal inputted to the gate wiring, while character S denotes a display signal inputted to the source wiring. Further, reference character $V_{com}$ designates a common potential supplied to the common electrode, while character $V_s$ denotes a pixel potential supplied to the pixel electrode. FIG. 14 is drawn by focusing attention to a scanning signal for the single gate wiring 1 and to a display signal for the single source wiring.

As shown in FIG. 14, a positive gate pulse having a duration corresponding to one horizontal period ("1 H" shown in FIG. 14) is added to the scanning signal G. Consequently, the TFT is brought into an ON-state. In the horizontal period in which this TFT is in the ON-state, the level of the display signal S is at the pixel potential $V_s$ corresponding to an associated pixel. This pixel potential $V_s$ is written to the pixel electrode 6. The liquid crystals are driven by the electric field generated between the pixel electrode 6 and the common electrode 5. That is, the potential difference ($V_s$–$V_{com}$) between the pixel potential $V_s$ and the common potential $V_{com}$ is employed as a driving voltage.

Regarding the scanning signal G, in the next horizontal period, the TFT connected to the adjacent gate wiring 1 is turned on, so that a gate pulse is not added to the scanning signal G. That is, the scanning signal G is a signal adapted so that one gate pulse is added thereto in one vertical period. On the other hand, regarding the display signal S, in the next horizontal period, the level thereof is the pixel potential $V_s$ to be written to the pixel electrode corresponding to the adjacent gate wiring. Therefore, the display signal S is a signal adapted so that the pixel potentials $V_s$ of the plural pixel electrodes arranged in a line are sequentially set out as the levels thereof respectively associated with consecutive horizontal periods thereof.

The display signal, in which the pixel potentials $V_s$ of the plural pixel electrodes arranged in a line are set out as such levels thereof, is supplied to the single source wiring 3. Thus, on the source wiring 3, even a pixel, the associated TFT of which is turned off, is supplied with the pixel potential $V_s$ associated with another pixel placed on the same source wiring. This pixel potential $V_s$ associated with the latter pixel causes the following problems.

As shown in FIGS. 12A and 12B, the source wiring 3 is disposed in the vicinity of the pixel electrode 6. In the case of the pixel, the associated TFT of which is turned off, the associated source wiring 3 and the associated pixel electrode 6 are at different potentials, respectively. For example, in a case where the adjacent pixels placed on the same source wiring respectively perform a white display and a black display, an electric potential causing a black display is applied to the pixel electrode 6, while an electric potential causing a white display is applied to the source wiring 3. Therefore, an error electric field differing from the electric field generated between the pixel electrode 6 and the common electrode 5 is generated between the pixel electrode 6 and the source wiring 3. The error field, which is generated between the pixels electrode 6 and the source wiring 3 at such writing of another pixel, affects a voltage applied to the liquid crystal and disturbs the orientation of the liquid crystals. Consequently, a problem has occurred, in which degradation in quality of display, such as a crosstalk, is caused.

As described above, the conventional. IPS liquid crystal apparatus has the problems that the error field generated between the pixel electrode 6 and the source wiring 3 at the writing of another pixel disturbs the orientation of the liquid crystals and causes defective display. To solve this problem, the width of the common electrode 5 shown in FIGS. 12A and 12B should be broadened. Thus, the conventional IPS liquid crystal apparatus has the problems that the aperture rate is restricted, that due to such restriction on the aperture rate, the aperture rate cannot be improved and the efficiency in using light is decreased.

Thus, the conventional IPS liquid crystal apparatus has the problems that the aperture rate is restricted by the error field between the pixel electrode 6 and the source wiring 3 at the writing of another pixel.

SUMMARY OF THE INVENTION

The invention is accomplished in view of such problems. An object of the invention is to provide a liquid crystal display apparatus, which is enabled to reduce the error electric field between the pixel electrode 6 and the source wiring 3 at the writing of another pixel and which has high quality of display, and to provide a driving method therefor.

According to a first aspect of the invention, there is provided a liquid crystal display apparatus, which has plural gate wirings (for example, gate wirings 1 according to an embodiment of the invention) formed on a substrate (for instance, a TFT array substrate 100 according to the embodiment of the invention), source wirings (for example, source wirings 3 according to the embodiment of the invention) intersecting with the gate wirings through an insulating film, switching elements (for instance, TFTs 100 according to the embodiment of the invention) connected to the source wirings, pixel electrodes (for example, pixel electrodes 6 according to the embodiment of the invention) connected to the source wirings through the switching elements, to which pixel potentials (for example, pixel potential $V_s$ according to the embodiment of the invention) are inputted according to a driving voltage for driving liquid crystals, and common electrodes (for instance, common electrodes 5 according to the embodiment of the invention), disposed opposite to the pixel electrodes and adapted so that a common potential (for example, a common potential $V_{com}$ according to the embodiment of the invention) is inputted thereto. A scanning signal is inputted to the gate wrings so that one horizontal period of the liquid crystal display apparatus has a write time (for instance, a write time A according to a first embodiment of the invention), in which the pixel potential is written to the pixel electrode, and a non-write time (for example, a non-write time B according to the first embodiment of the invention) in which the pixel potential is not written to the pixel electrode. The pixel potential is inputted to the source wiring in the write time. An electric potential being closer to the common potential than the pixel potential is inputted to the source wiring in the non-write time. Consequently, an error electric field between the pixel electrode 6 and the source wiring 3 can be reduced. The quality of display can be improved.

According to a second aspect of the invention, in the aforementioned display apparatus, an electric potential being substantially equal to the common potential is inputted to the source wiring in the non-write time. Consequently, an error electric field between the pixel electrode 6 and the source wiring 3 can be reduced. The quality of display can be improved.

According to a third aspect of the invention, in the aforementioned display apparatus, an electric potential being close to the common potential is inputted in the non-write time by undergoing a reverse driving operation so that the pixel potentials to be applied to adjacent ones of the source wirings differ from each other in polarity, and by electrically connecting one of the adjacent ones of the source wirings with the other of the adjacent ones of the source wirings. Consequently, the error electric field between the pixel electrode 6 and the source wiring 3 can be reduced. The quality of display can be improved.

According to a fourth aspect of the invention, the aforementioned display apparatus further includes a driving circuit for inputting the pixel potentials to the source wirings according to a predetermined gradation voltage, and a voltage supply circuit for supplying the gradation voltage to the driving circuit according to a supplied reference voltage. An electric potential, which is closer to the common potential than the pixel potential, is inputted to the source wirings by changing the reference voltage. Consequently, the error electric field between the pixel electrode 6 and the source wiring 3 can be reduced. The quality of display can be improved.

According to a fifth aspect of the invention, in the aforementioned display apparatus, a liquid crystal is driven horizontally to the substrate according to an electric field generated by the pixel potential of the pixel electrode and the common potential of the common electrode. Consequently, the error electric field between the pixel electrode 6 and the source wiring 3 can be reduced. The aperture rate can be enhanced.

According to a sixth aspect of the invention, there is provided a driving method for a liquid crystal display apparatus, which has plural gate wirings formed on a substrate, source wirings intersecting with the gate wirings through an insulating film, switching elements connected to the source wirings, pixel electrodes connected to the source wirings through the switching element, to which pixel potentials are inputted according to a driving voltage for driving liquid crystals, and common electrodes, disposed opposite to the pixel electrodes and adapted so that a common potential is inputted thereto. The method including the steps of supplying a scanning signal to the gate wirings in such a way as to form a write time, in which a pixel potential is written to the pixel electrode, in one horizontal period, of inputting the pixel potential to the source wrings in the write time, of supplying a scanning signal to the gate rings so that the one horizontal period has a non-write time in which the pixel potential is not written thereto, and of inputting an electric potential being closer to the common potential than the pixel potential to the source wirings in the non-write time. Consequently, the error electric field between the pixel electrode 6 and the source wiring 3 can be reduced. The quality of display can be improved.

According to a seventh aspect of the invention, in the aforementioned driving method for a liquid crystal display apparatus, an electric potential being substantially equal to the common potential is inputted to the source wirings in the non-write time. Consequently, the error electric field between the pixel electrode 6 and the source wiring 3 can be reduced. The quality of display can be improved.

According to an eighth aspect of the invention, in the aforementioned driving method for a liquid crystal display apparatus, the liquid crystal display apparatus is a in-plane switching liquid crystal display apparatus, which drives liquid crystals horizontally to the substrate according to an electric field generated by the pixel potential of the pixel electrode and the common potential of the common electrode. Consequently, the error electric field between the pixel electrode 6 and the source wiring 3 can be reduced. The aperture rate can be enhanced.

According to a ninth aspect of the invention, there is provided a liquid crystal display apparatus, which has plural gate wirings formed on a substrate, source wirings intersecting with the gate wirings through an insulating film, switching elements connected to the source wirings, pixel electrodes connected to the source wirings through the switching elements, to which pixel potentials are inputted according to a driving voltage for driving liquid crystals, and common electrodes, disposed opposite to the pixel electrodes and adapted so that a common potential is inputted thereto. A time period corresponding to one horizontal period of the liquid crystal display apparatus includes a first time including a moment at which a state of the switching element changes from an ON-state to an Off-state, and a second time that is present in such a way as to be precedent to the first time. The pixel potential is inputted to the source wirings in the first time. An electric potential being closer to the common potential than the pixel potential is inputted to the source wirings in the second time. Consequently, the error electric field between the pixel electrode 6 and the source wiring 3 can be reduced. The aperture rate can be enhanced.

According to a tenth aspect of the invention, there is provided a liquid crystal display apparatus, which has plural gate wirings formed on a substrate, source wirings intersecting with the gate wirings through an insulating film, switching elements connected to the source wirings, pixel electrodes connected to the source wirings through the switching elements, to which pixel potentials are inputted according to a driving voltage for driving liquid crystals, and common electrodes, disposed opposite to the pixel electrodes and adapted so that a common potential is inputted thereto. The method includes the step of inputting an electric potential being closer to the common potential than the pixel potential to the source wirings in a time period corresponding to one horizontal period of the liquid crystal display apparatus, and the step of supplying the pixel potential until a state of the switching element changes from an ON-state to an OFF-state after the potential being closer to the common potential than the pixel potential is inputted to the source wirings. Consequently, the error electric field between the pixel electrode 6 and the source wiring 3 can be reduced. The aperture rate can be enhanced.

The invention can provide a liquid crystal apparatus, which is enabled to reduce an error electric field generated by a pixel during the writing of another pixel and which has high quality of display, and also can provide a driving method therefor.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
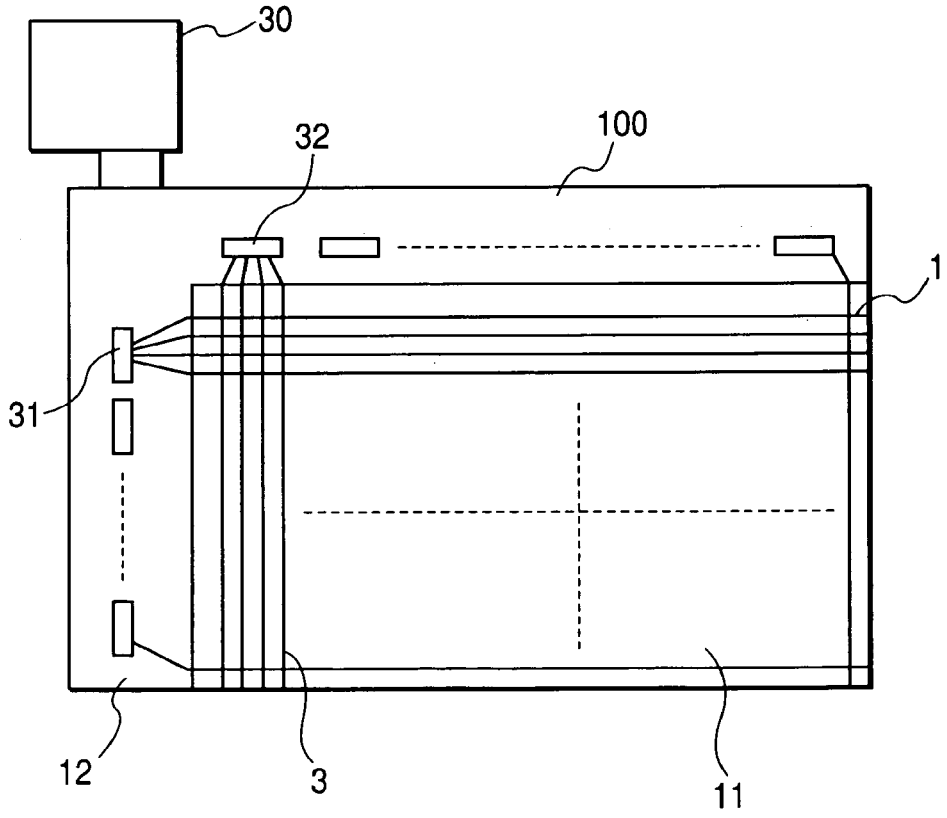
FIG. 1 is a plan view illustrating the configuration of a liquid crystal display apparatus according to the invention.

Hereinafter, embodiments, to which the invention can be applied, are described. The following description describes the embodiments of the invention. The invention is not limited to the embodiments described hereinbelow. For clarification of explanation, the following description is appropriately omitted and simplified. Additionally, those skilled in the art can easily change, add and convert each of elements of the following embodiments within the scope of the invention. Incidentally, in the drawings, same reference character designates same element. Accordingly, the description of such an element is omitted.

First Embodiment

Generally, in an active matrix liquid crystal display apparatus, a color filter (CF) substrate and a TFT array substrate, which are paired with each other, are disposed opposite to each other at a certain distance. Further, a liquid crystal layer is sandwiched between these substrates. Moreover, gate wirings and source wirings, which intersect with one another through a gate insulating film, are formed on the TFT array substrate. Furthermore, switching elements, such as a thin film transistor, connected to the gate wirings and the source wirings are formed. Additionally, comb-like pixel electrodes constituted by plural electrodes provided in parallel to the source wirings are connected to the switching elements. Besides, comb-like common electrodes constituted by plural electrodes disposed alternately in parallel to the plural electrodes of the pixel electrodes are formed. An electric field being nearly parallel to is applied to the liquid crystal layer by applying a voltage between the pixel electrodes and the common electrodes. In the case of a transmissive liquid crystal display apparatus, a planar light source device is attached to the rear thereof as a backlight. A desired image is displayed by causing the liquid crystal layer to selectively transmit light sent from the backlight.

The configuration of the liquid crystal display apparatus according to the invention is described by using FIG. 1. FIG. 1 is a plan view illustrating the TFT array substrate in a liquid crystal display panel of the liquid crystal display apparatus. The TFT array substrate is used in an active matrix liquid crystal display apparatus. Reference numeral 1 designates a gate wiring, numeral 3 denotes a source wiring, numeral 11 designates a display region, numeral 12 denotes a picture frame region, numeral 30 denotes a control portion, numeral 31 designates a gate driver IC, numeral 32 denotes a source driver IC, and numeral 100 designates the TFT array substrate.

In the display region 11, the plural gate wirings 1 and the plural source wirings 3 are formed in such a way as to intersect with one another. The gate wirings 1 and the source wirings 3 are extended to the picture frame region serving as a nondisplay region. In the picture frame region 12 provided on the periphery of the display region 11, the gate driver ICs 31 and the source driver ICs 32 are connected to one another through, for example, an ACF. Moreover, on the TFT array substrate, plural gate driver ICs 31 are disposed at an end part of a side thereof, which is perpendicular to the gate wirings 1, and plural source driver ICs 32 are disposed at an end part of a side thereof, which is perpendicular to the source wirings 3. That is, the gate driver ICs 31 and the source driver ICs 32 are disposed on end parts of adjacent sides of the TFT array substrate 100, respectively. The plural gate driver ICs 31 are disposed along an end part of and along a side of the TFT array substrate 100. The plural source driver ICs 32 are disposed along an end part of and along a side adjoining the side, along which the gate driver ICs 31 are disposed, of the TFT array substrate 100.

A control portion 30 for supplying electric power and signals to each of the driver ICs is formed in the proximity of a corner portion at which the side provided with the gate driver ICs 31 intersects with the side provided with the source driver ICs 32. This control portion 30 is connected to each of the driver ICs put on the TFT array substrate 100 through wirings, such as FPC. The control portion 30 outputs digitalized display data (represented by, for instance, R, G, and B signals respectively associated with red, green, and blue) and various kinds of control signals to each of the driver ICs according to information sent from an external input apparatus, such as a personal computer. Each of the driver ICs is driven by the electric power sent from the control portion 30, and outputs a scanning signal or a display signal to the gate wiring 1 or the source wiring 3 according to the control signal and the display data sent from the control portion 30. Major control signals sent to the gate driver ICs 31 are vertical synchronization signals, gate driver clock signals, and so on. On the other hand, major control signals sent to the source driver ICs 32 are horizontal synchronization signals, start pulse signals, source driver clock signals, and so forth. Moreover, the control portion 30 outputs a gradation voltage, which is generated according to a reference voltage, to the source driver ICs 32. The source driver ICs 32 latch the inputted display data therein in a time sharing manner. Thereafter, a DA (digital to analog) conversion is performed in synchronization with the horizontal synchronization signal inputted from the control portion 30. Display signals are outputted to the source wiring 3 from output terminals of the source driver ICs 32 according to analog voltages obtained by this conversion.

A TFT (not shown) is formed in the vicinity of each of the intersections between the gate wirings 1 and the source wirings 3. Scanning signals are supplied to the gate wirings 1 in such a manner as to switch between on and off states of the TFT connected thereto. On the other hand, display signals for driving the liquid crystals are supplied to the source wirings 3. In a period during which the TFT is turned on, the source wiring 3 and the pixel electrode formed in each of the pixels are conducted to each other, so that the display signal is written to the pixel electrode. In a state in which the TFT is turned on, the pixel potential $V_s$ is inputted to the pixel electrode according to the display signal. On the other hand, the common potential $V_{com}$ is always supplied to the common electrode disposed opposite to the pixel electrode. The liquid crystal is driven by a driving voltage generated between the pixel electrode and the common electrode according to this display signal. The driving voltage is generated according to the difference between the pixel potential $V_s$ and the common potential $V_{com}$. Concretely, the driving voltage is $(V_s-V_{com})$.

Among the plural gate wirings 1, the gate wirings, the associated TFT of each of which is turned on, are sequentially scanned from the top one thereof. Then, display signals are sequentially supplied to the source wirings 3, the TFT of each of which is turned on, in synchronization with the scanning of the gate wirings 1, the associated TFT of each of which is turned on. That is, display signals for the pixels are written thereto in a period during which the associated TFT is turned on. The display signal is supplied to the source wirings 3 so that the pixel potential $V_s$ is written to the gate wiring 1, the associated TFT of which is turned on. These scanning signals and display signals are supplied from the gate driver IC or the source driver IC 32.

A period of turning-on of TFTs connected to all the gate wirings is called a vertical period (or a vertical scanning period). Generally, a vertical scanning frequency is 60 Hz. That is, in a time period of (1/60) sec., the gate wirings are sequentially scanned from the top one to the bottom one thereof, so that the display signals are written to all the pixel electrodes. Therefore, the rewriting of the screen is performed 60 times per second. Furthermore, a period of turning-on of each of TFTs connected to the gate wirings is called a horizontal period (or a horizontal scanning period). A horizontal scanning frequency is given by multiplying (the frequency of the vertical period) by (the number of the gate wirings). Therefore, generally, a write time assigned to one gate wiring 1, that is, the horizontal period is given by dividing (1/60 sec.) by (the number of the gate wirings). Within a time allotted to this one gate wiring 1, the pixel potential $V_s$ is written to the pixel electrode associated with this gate wiring. The rewriting of the screen is performed by sequentially performing scanning on the gate wirings from the top one thereof. Then, when the writing is completed up to the bottom, the writing is repeatedly performed from the top again.

Figure 2:
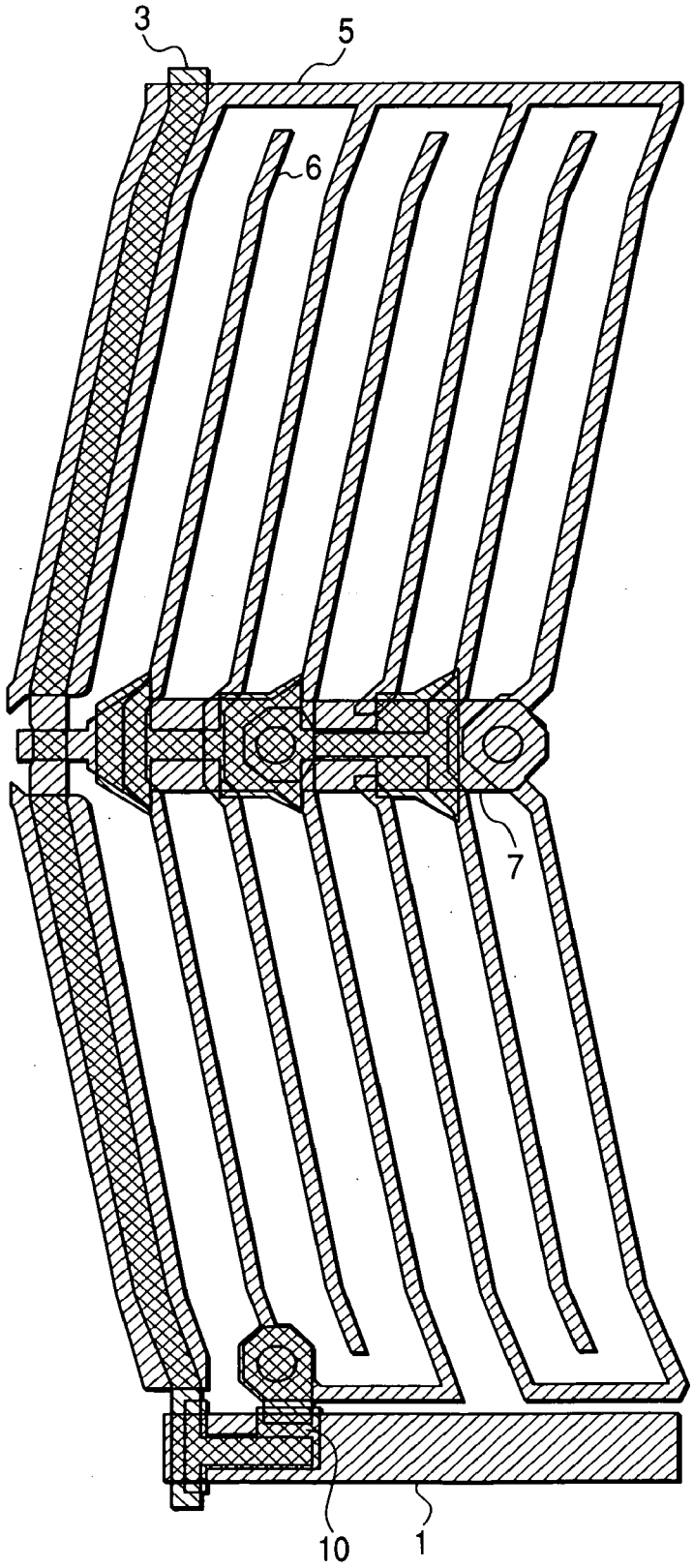
FIG. 2 is a plan view illustrating a pixel portion of the liquid crystal display apparatus according to the invention.

The configuration of a pixel, in which this TFT is formed, is described by using FIG. 2. FIG. 2 is a plan view illustrating the configuration, of a pixel in the IPS liquid crystal display apparatus.

In FIG. 2, reference numeral 3 designates a source wiring, which extends from an end portion of one pixel in a direction being nearly perpendicular to the direction of an electric field generated between the common electrode 5 (to be described later) and the pixel electrode 6. The film thickness of this source wiring 3 ranges, for instance, from 200 nm to 500 nm. Reference numeral 5 is a comb-like common electrode, which is constituted by plural electrodes disposed alternately in parallel to plural electrodes of the pixel electrode 6 (to be described later) and which is also called a counter electrode. The film thickness of this common electrode 5 is, for example, 100 nm. Reference numeral 6 denotes a comb-like pixel electrode that is constituted by plural electrodes, which are connected to a thin film transistor and provided in parallel to the source wiring 3, and that is made of metal, such as chrome (Cr), or formed of a transparent electrically conductive film made of ITO (Indium Tin Oxide). Reference numeral 7 designates a common capacitance wiring made of metal, such as chrome (Cr), and connected to the common electrode 5 through a through hole. In this example, each of the source wiring 3, the common electrode 5, and the pixel electrode 6 is bent once at the central portion thereof. Further, this inflection point is provided on the common capacitance wiring 7. Thus, with the configuration including bent electrodes, two directions can be obtained as the direction in which the liquid crystal is driven. Consequently, deterioration in viewing-angle characteristics, which would occur in a specific direction in an IPS liquid crystal panel, can be prevented.

As shown in FIG. 2, the source wiring 3 and the common electrode 5 provided between the pixels adjoining in a lateral direction that is the direction, in which an electric field is generated, overlap with each other. In, other words, the common electrode 5 is provided on the source wiring 3 in such a way as to wrap around the source wiring 3 through an insulating film 4 and an organic planarization film 9. A TFT 10 is formed in the vicinity of the intersection between the gate wiring 1 and the source wiring 3. This TFT 10 is turned on/off by a gate pulse of a scanning signal inputted to the gate wiring 1. In a state in which the TFT 10 is turned on, the source wiring 3 and the pixel electrode 6 are conducted to each other, and the pixel potential is written thereto.

Figure 3A:
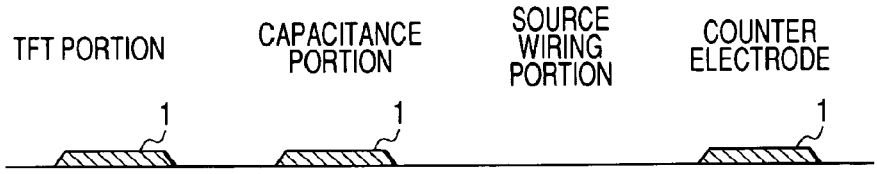
FIGS. 3A to 3E are views illustrating a manufacturing flow of the liquid crystal display apparatus according to the invention.
Figure 3B:
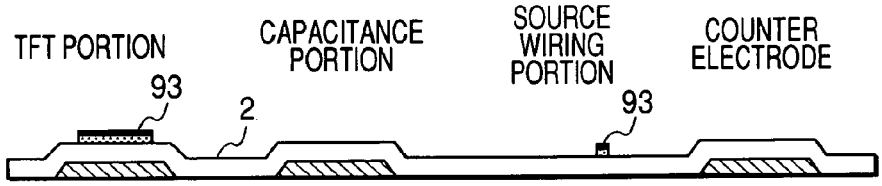

A process of manufacturing the liquid crystal display apparatus, in which pixels shown in FIG. 2 are formed, is described by using FIGS. 3A to 3E. FIGS. 3A to 3E are process cross-sectional views illustrating a manufacturing process of the TFT array substrate. First, as shown in FIG. 3A, on an insulating substrate, a film made of Cr, Al, Ti, Ta, Mo, W, Ni, Cu, Au, Ag, or an alloy mainly consisting of these metals, or an electrically conductive transparent film, such as an ITO film, or a multilayer film consisting of these films is formed by a sputtering method or evaporation method, and subsequently, the gate wiring 1, a gate electrode, and a common capacitance wiring are formed thereon by photoengraving and processing. Then, as shown in FIG. 3B, the gate insulating film 2 made of silicon nitride or the like is formed. Moreover, a semiconductor film 93 made of an amorphous silicon, polycrystalline polysilicon or the like, alternatively, in the case of an n-TFT, a contact film made of $n^+$-amorphous-silicon, $n^+$-polycrystalline-polysilicon or the like heavily doped with impurities, such as P, is continuously formed by, for example, a plasma CVD method, an atmospheric CVD method, or a reduced-pressure CVD method. Subsequently, the contact film and the semiconductor film 93 are processed like islands.

Figure 3C:
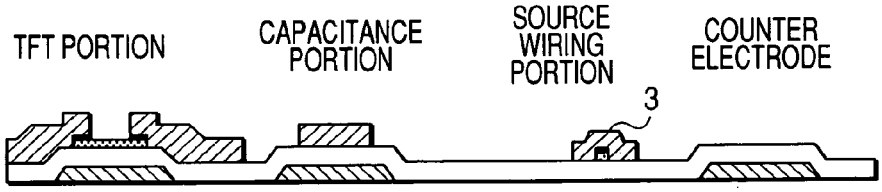

Subsequently, as shown in FIG. 3C, a film made of Cr, Al, Ti, Ta, Mo, W, Ni, Cu, Au, Ag, or an alloy mainly consisting of these metals, or an electrically conductive transparent film, such as an ITO film, or a multilayer film consisting of these films is formed by a sputtering method or evaporation method. Then, the source wiring 3, a source electrode, a drain electrode and a retention volume electrode are formed thereon by photoengraving and by fine processing techniques. Furthermore, the contact film is etched and removed from a channel region by using the source electrode and the drain electrode or a photoresist, which is used for forming these electrodes, as a mask.

Figure 3D:
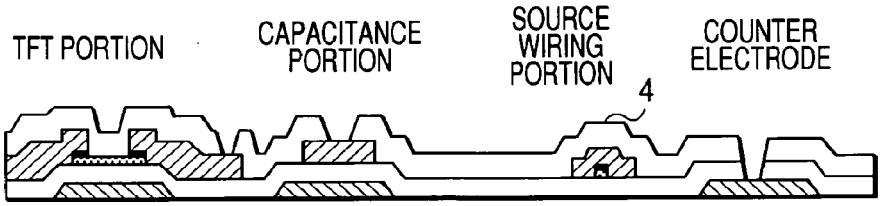

Then, the insulating film 4 made of an inorganic material, such as silicon nitride, oxide silicon, or the like or constituted by an organic film is formed. Thereafter, a contact hole is formed by photoengraving and by subsequently etching. The source wiring 3 or the gate wiring 1 is exposed by providing the contact hole. The insulating film 4 may be a laminated film constituted by the inorganic film and the organic film. Consequently, the configuration shown in FIG. 3D is obtained.

Figure 3E:
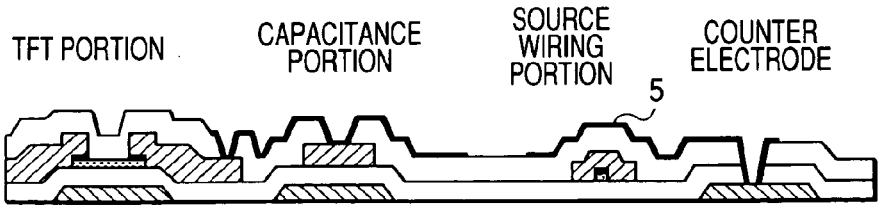

After a film made of Cr, Al, Ti, Ta, Mo, W, Ni, Cu, Au, Ag, or an alloy mainly consisting of these metals, or an electrically conductive transparent film, such as an ITO film, or a multilayer film consisting of these films is formed on the insulating film 4, as shown in FIG. 3E, the pixel electrode and the common electrode 5 are formed by patterning. Consequently, the common electrode can be formed on an opening portion of the organic planarization film 9 in a disconnection repairing region or on the laminated part.

The TFT array substrate 100 composing the IPS liquid crystal display apparatus according to this embodiment can be manufactured by the above process. Further, the liquid crystals are sandwiched between this TFT substrate 100 and the CF substrate disposed opposite thereto and bonded therebetween by a sealant. At that time, liquid crystal molecules are oriented at a predetermined angle by a rubbing method, an optical orientation method, or the like. Incidentally, any known methods may be employed as the method of orienting the liquid crystals. Additionally, the gate driver ICs 31, the source driver ICs 32, and the common capacitance power supplies are connected to the gate wirings, the source wirings, and the common capacitance wiring, respectively, to thereby manufacture the liquid crystal display apparatus.

Figure 4:
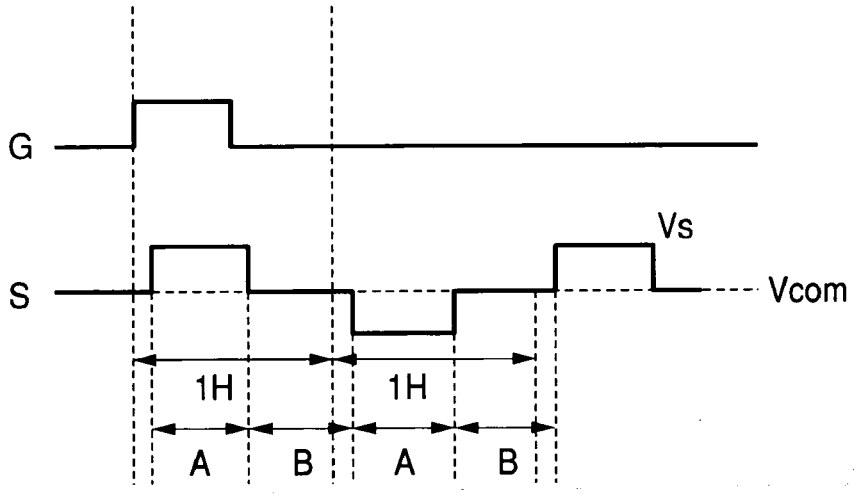
FIG. 4 is a timing chart illustrating signal processing in the liquid crystal display apparatus according to the invention.

In the configuration shown in FIG. 2, the source wirings 3 and the pixel electrodes 6 are formed so that each of the source wirings is close to the associated pixel electrode. According to the invention, to reduce an error electric field generated between the source wiring 3 and the pixel electrode of a pixel, which are disposed close to each other, at the writing in another pixel, the following signal processing is performed. This signal processing is described by using FIG. 4. FIG. 4 is a timing chart illustrating a scanning signal and a display signal.

In FIG. 4, reference character G designates a scanning signal to be inputted to the gate wiring, and character S denotes a display signal to be inputted to the source wiring. Also, reference character $V_{com}$ designates a common potential to be supplied to the common electrode, and character $V_s$ denotes a pixel potential to be written to the pixel electrode. FIG. 4 is drawn by focusing attention to a scanning signal for the single gate wiring 1 and to a display signal for the single source wiring.

A positive gate pulse is added to the gate wiring 1 selected as shown in FIG. 4. Consequently, the TFT is put into an ON-state. Thus, the writing of the pixel potential $V_s$ to the pixel electrode 6 is performed. That is, in a period in which the TFT is in an ON-sate, the level of a display signal is the pixel potential $V_s$ of an associated pixel. Also, the writing thereof to the pixel electrode is performed. Then, the liquid crystal is driven by an electric field generated between the pixel electrode 6 and the common electrode 5. That is, the electric potential difference ($V_s$–$V_{com}$) between the pixel potential $V_s$ and the common potential $V_{com}$ is used as a driving voltage. The liquid crystal is driven horizontally to the substrate according to this driving voltage. Incidentally, among the plural gate wirings 1, a gate pulse is inputted to the gate wiring, which is shifted in turn from the top one of the plural gate wirings by one horizontal period ("1H" shown in FIG. 4). Then, the writing of the pixel potential $V_s$ is sequentially performed on the pixel electrodes 6 of pixels each associated with the gate wiring to which the gate pulse is inputted.

According to the invention, the duration of the gate pulse causing the TFT to turn on is set to be substantially half of one horizontal period. The state of the TFT 10 is switched so that in a first half of one horizontal period, the TFT 10 is turned on, and that in a second half thereof, the TFT 10 is turned off. The level of the display signal inputted to the source wiring 3 is the pixel potential $V_s$ in a time period corresponding to this first half, while that of this display signal is the common potential $V_{com}$ or a potential closer to the common potential $V_{com}$ than the pixel potential Vs in a time period corresponding to the second half. Because the state of the TFT is changed from the ON-state to an OFF-state with timing with which the level of the scanning signal falls, the potential of the display signal is held in this potential is written to the pixel electrode. An actual driving operation may be performed so that differences in the rising timing and the falling timing between the scanning signal and the display signal are provided to thereby set the rising timing, with which the scanning signal rises, to be earlier as shown in FIG. 4.

As shown in FIG. 4, a time, in which the pixel potential $V_s$ is supplied to the source wiring 3, corresponding to the time period, in which the TFT is turned on, is defined as a write time A. Conversely, a time, in which the common potential $V_{com}$ or the potential close to the common potential is supplied to the source wiring, corresponding to the time period, in which the TFT is turned off, is defined as a non-write time B. In the write time A, the level of the display signal S is the pixel potential $V_s$. In the non-write time B, the level of the display signal S is the common potential $V_{com}$ or the potential close to the common potential $V_{com}$. In one horizontal period, a time, during which the TFT 10 is turned on, is the first half thereof, while a time, during which the TFT is turned off, is the second half. Thus, the write time A is the first half of the horizontal period, while the non-write time B is the second half of the horizontal period. Incidentally, FIG. 4 is drawn by assuming the potential in the non-write time B to be the common potential $V_{com}$.

Similarly, in the next horizontal period, the first half thereof is the write time A, while the second half thereof is the non-write time B.

Incidentally, in this embodiment, a reverse driving operation, in which polarity is changed every vertical line, is performed. That is, the display signal S is reversed so that the pixel potentials $V_s$ respectively applied to the adjacent source wirings 3 differ in polarity from each other. Thus, in a horizontal period subsequent to a horizontal period in which the pixel potential $V_s$ has positive polarity and also has a level being higher than the common potential $V_{com}$, the pixel potential $V_s$ is of negative polarity and has a level being lower than the common potential $V_{com}$. In a further subsequent horizontal period, the pixel potential $V_s$ has positive polarity and also has a level being higher than the common potential $V_{com}$. The display signal S is inputted by repeating this process. Incidentally, to the adjacent gate wiring 1, a gate pulse is added in the horizontal period (in which the pixel potential $V_s$ has the level being lower than the common potential $V_{com}$). Then, the reversed pixel potential $V_s$ is written to the pixel electrode 6. Thus, according to the potentials in the write time A corresponding to the first half of one horizontal period, the pixel potentials $V_s$ are respectively written to the pixel electrodes 6 in turn.

Figure 13:
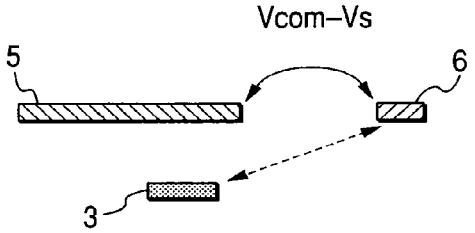
CONVENTIONAL ART FIG. 13
FIG. 13 is a schematic view illustrating an electric field generated in the IPS liquid crystal display apparatus.
Figure 14:
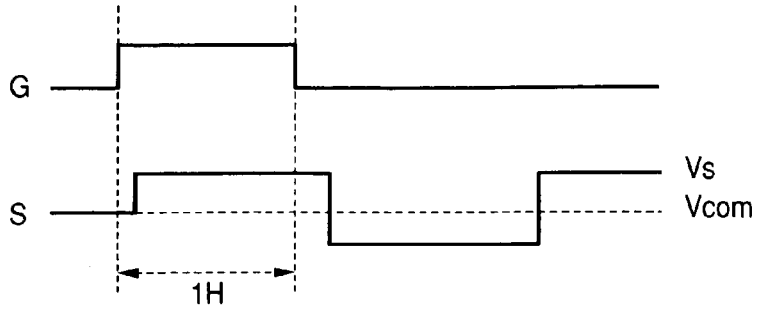
CONVENTIONAL ART FIG. 14
FIG. 14 is a timing chart illustrating signal processing in the conventional liquid crystal display apparatus.

A relationship between the potential of the common electrode 5 and that of the pixel electrode 6 or that of the source wiring 3 is described by using FIG. 13. When the writing is performed on the pixel, the potential $V_s$ which is supplied to the source wiring 3 is applied to the pixel electrode 6. Therefore, the potential of the pixel electrode is $V_s$, and is maintained by doing the gate signal off. The voltage between the common electrode 5 and the pixel electrode 6 is ($V_{com}$–$V_s$). The potential difference between the source wiring 3 and the pixel electrode 6 is not generated. In other words, in this state, the liquid crystal is driven at ($V_{com}$–$V_s$). However, When the next writing is performed on the pixel, and the potential which is supplied to the source wiring 3 is different from the potential in previous writing, i.e. when the display data of the next pixel is different from the previous pixel, the potential difference between the source wiring 3 and the pixel electrode 6 is generated. In the result, since the liquid crystal is driven at ($V_{com}$–$V_s$) which is the voltage between the common electrode 5 and the pixel electrode 6, and an error voltage which is different from ($V_{com}$–$V_s$) and is generated between the source wiring 3 and the pixel electrode 6, the orientation of the liquid crystals is distributed and causes defective display, such as a crosstalk.

Figure 12A:
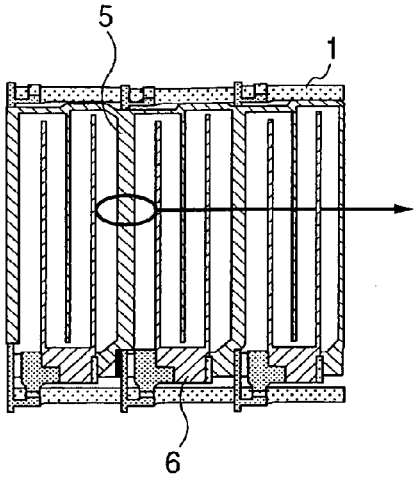
FIGS. 12A and 12B are views illustrating the configuration of a pixel in a conventional IPS liquid crystal display apparatus.
Figure 12B:
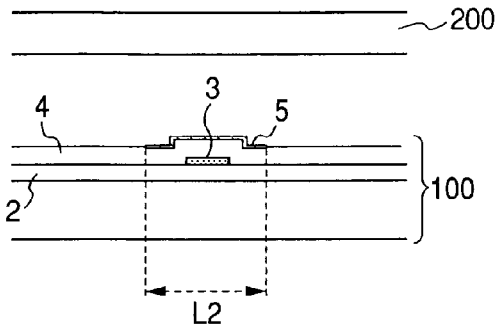
CONVENTIONAL ART FIG. 12B

On the other hand, in the present invention, one horizontal period has the write time A and the non-write time B. In the non-write time B, the voltage between the source wiring 3 and the pixel electrode 6 is ($V_{com}$–$V_s$), because the potential $V_{com}$ which is equal to the potential of the common electrode 5 is supplied to the source wiring 3. Therefore, in the present invention, the Liquid crystal does not undergo influence by the potential except ($V_{com}$–$V_s$). As the above, since not only $V_s$ but also $V_{com}$ or the potential which is near $V_{com}$ is supplied to the source wiring 3 in predetermined period, the error electric field which is generated between the source wiring 3 and the pixel electrode 6 is reduced. Consequently, the error electric fields can effectively be reduced. Thus, the defective display, such as a crosstalk, can be prevented. Consequently, the width L2 of the common electrode shown in FIGS. 12A and 12B can be narrowed. Thus, the aperture rate can be enhanced. The invention can provide a liquid crystal display apparatus whose efficiency in using light is high.

Figure 5:
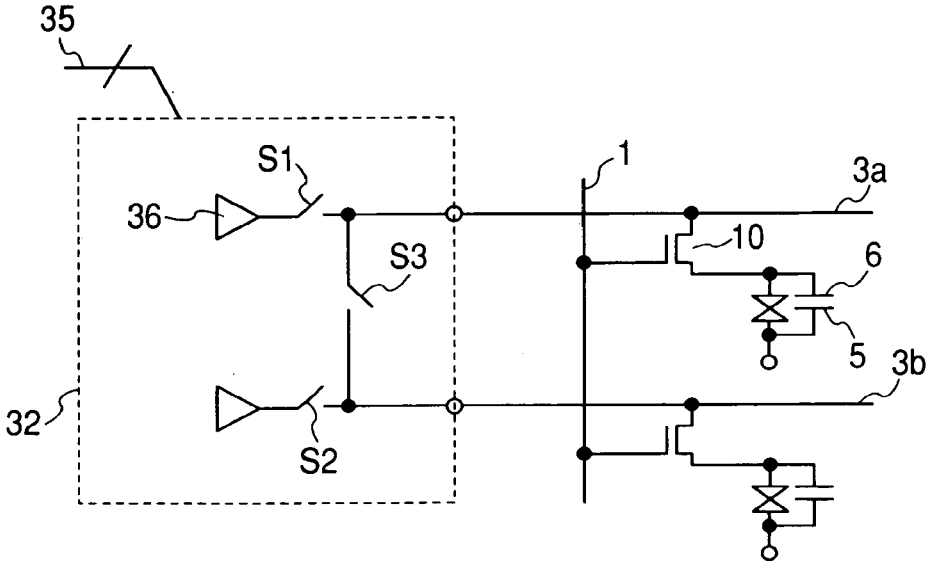
FIG. 5 is a circuit view illustrating the configuration of a driver IC according to a first embodiment of the invention.
Figure 6:
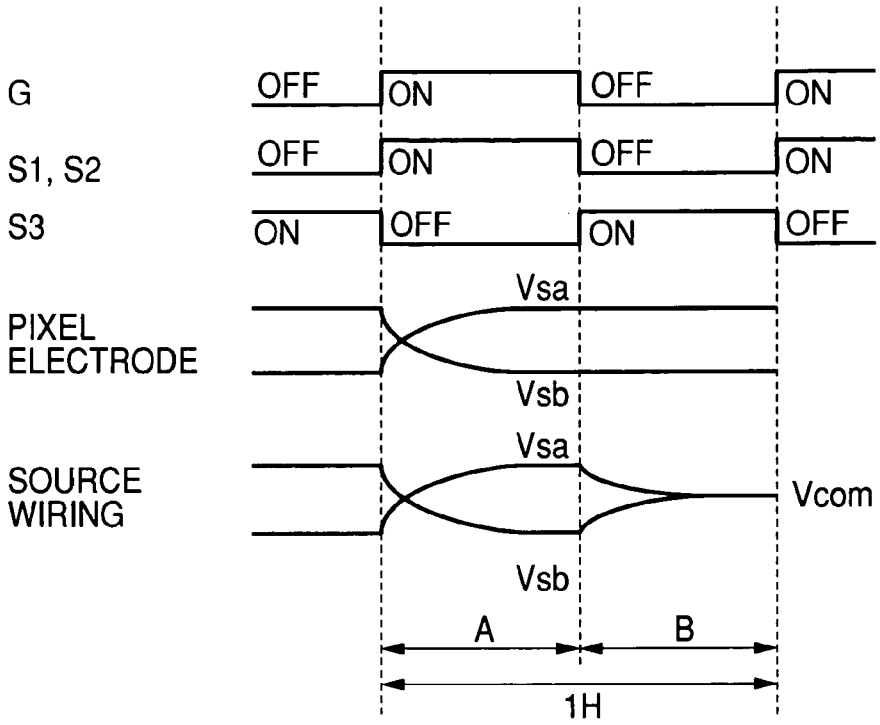
FIG. 6 is a timing chart illustrating signal processing in a liquid crystal display apparatus according to the first embodiment of the invention.

Such signal processing can be performed by the gate driver ICs 31 and the source driver ICs 32. The configuration of the source driver IC 32 for performing such signal processing is described by using FIGS. 5 and 6. FIG. 5 is a circuit view schematically showing the configuration of the source driver IC 32. FIG. 6 is a timing chart showing the scanning signal, the display signal, and so on. FIGS. 5 and 6 show a single gate wiring, and adjacent two source wirings 3. One of the two source wirings 3 is a source wiring 3*a*, and the other is a source wiring 3*b*. In this embodiment, the electric potential being closer to the common potential $V_{com}$ than the pixel potential $V_s$ in the non-write period B is generated by short-circuiting the adjacent source wirings 3.

Digital display data is inputted from the control portion 30 to the source driver IC 32 through a data line 35. Also, a gradation voltage generated according to a reference voltage is supplied from the control portion 30 to the source driver IC 32. The gradation voltage is inputted to a DA converter (not shown), which is placed in the source driver IC 32. The source driver IC 32 latches the inputted display data therein in a time sharing manner. Thereafter, the source driver IC 32 performs a DA (digital-to-analog) conversion in synchronization with the horizontal synchronization signal inputted from the control portion 30. That is, the DA converter outputs an analog voltage associated with the display data according to the gradation voltage. This analog voltage is amplified by an operational amplifier 36 to thereby generate a display signal S, which is outputted from an output terminal of the source driver IC 32 to the source wiring 3.

The display signal S generated by the source driver IC 32 in this way is outputted in synchronization with the scanning signal G generated by the gate driver IC. Reverse driving operations are performed on the adjacent two source wirings 3*a* and 3*b*. Thus, the pixel potentials $V_s$ respectively having positive and negative polarities with respect to the common potential $V_{com}$ are supplied to the adjacent source wirings. Incidentally, let $V_{sa}$ designate a pixel potential supplied to the source wire 3*a*, and let $V_{sb}$ denote a pixel potential supplied to the source wire 3*b*. Because the reverse driving operation is performed, $V_{sa}>V_{com}$, and $V_{sb}<V_{com}$.

As shown in FIG. 5, a switch S1 is connected to the source wiring 3*a* in the source driver IC 32. A switch S2 is connected to the source wiring 3*b* therein. Also, a switch S3 for short-circuiting the source wiring 3*a* and the source wiring 3*b* is formed between the source wirings 3*a* and 3*b* in the source driver IC 32.

A gate pulse, whose duration is half the one horizontal period, is generated in the one horizontal period in the gate driver IC 31 and used as the scanning signal G. In a time period in which the gate pulse is added thereto, the TFT 10 is put into an ON-state. Thus, this time period is the write time A. In the write time A, the gate pulse is added to the scanning signal so that the TFT 10 is turned on. Further, in the write time A, the switches S1 and S2 are turned on, and only the switch S3 is turned off. Consequently, the source wiring 3 and the operational amplifier 36 are conducted. The pixel potential $V_{sa}$ is inputted to the source wiring 3*a*, while the pixel potential $V_{sb}$ is supplied to the source wiring 3*b*. In the write time A, electric charge is charged from the source wiring 3 to the pixel electrode 6 so that the potential thereof is the pixel potential $V_s$. Then, the charging thereof is finished before the gate pulse falls. Thus, the potential of the pixel electrode 6 becomes the pixel potential $V_s$. The pixel electrode 6 is maintained at the potential at the time at which the TFT 10 is turned off, that is, at the pixel potential $V_s$.

On the other hand, in the non-write time B, no gate pulses are added to the scanning signal G so that the TFT 10 is turned off. In the non-write time B, the switches S1 and S2 are turned off, and only the switch S3 is turned on. Consequently, the source wirings 3*a* and 3*b* are electrically connected to each other and short-circuited. Electric charge charged in the pixel electrode 6 is discharged, so that the potentials of the source wires 3*a* and 3*b* are equal to each other. The potential of each of the source wires 3*a* and 3*b* is a mean value of $(V_{sa}+V_{sb})$, concretely, $(V_{sa}+V_{sb})/2$. Incidentally, because the reverse driving operation is performed, the potential $V_{sa}$ and the potential $V_{sb}$ relative to the common potential $V_{com}$ are opposite in sign to each other. For instance, when $V_{sa}$ is positive and $V_{sb}$ is negative relative to the common potential $V_{com}$, the value of $(V_{sa}+V_{sb})/2$ is closer to that of $V_{com}$ than those of $V_{sa}$ and $V_{sb}$. Consequently, the error electric field can be reduced. Further, when the potential difference between the potential $V_{sa}$ and the common potential $V_{com}$ is equal to that between the potential $V_{sb}$ and the common potential $V_{com}$, the potential of the source wiring 3 is equal to the common potential $V_{com}$. In the non-write time B, the common potential $V_{com}$ is inputted to the source wiring 3. Thus, the error electric field can be reduced still more.

FIG. 6 show electric potentials supplied to the two pixel electrodes and the two source wirings 3 illustrated in FIG. 5. The pixel electrode 6 associated with the source wiring 3*a* holds the potential obtained at the time, at which the gate signal falls in the write time A. Thus, thereafter, the potential of this pixel electrode is the pixel potential $V_{sa}$. In the write time A, the source wiring 3*a* has electric potential being equal to that of this pixel electrode 6. However, in the non-write time B, the common potential $V_{com}$ or the value being close to the common potential is supplied to the source wiring 3*a*. Similarly, the pixel electrode 6 associated with the source wiring 3*b* holds the potential obtained at the time, at which the scanning signal falls in the write time A. Thus, thereafter, the potential of this pixel electrode is the pixel potential $V_{sb}$. In the write time A, the source wiring 3*b* has electric potential being equal to that of this pixel electrode 6. However, in the non-write time B, the common potential $V_{com}$ or the value being close to the common potential is supplied to the source wiring 3*b*.

Consequently, in each of the pixels associated with the gate wirings other than the gate wiring 1 connected to the TFT 10 shown in FIG. 6, which is turned on, the error electric field between the source wiring 3 and the pixel electrode can be reduced. The aforementioned signal processing can be achieved with a simple configuration by providing the switch S3, which is used for short-circuiting between the adjacent source wirings, in the source driver IC 32. Such signal processing prevents the error electric field from disturbing the orientation of the liquid crystal and from causing defective display. Thus, the restriction on the aperture rate is alleviated. The aperture rate can be enhanced. Consequently, a liquid crystal display apparatus having a high aperture rate and high quality of display can be provided. Incidentally, the switching of each of the switches can be performed according to the control signal sent from the control portion 30.

Additionally, although the adjacent source wirings 3*a* and 3*b* are electrically connected to each other in the aforementioned embodiment, the source wirings 3 other than the adjacent source wirings may be electrically connected to each other. The error electric field can be reduced by electrically connecting the source wirings 3, which are reversely driven and have opposite polarities, to each other. Needless to say, the number of the wirings to be connected is not limited to 2. Three or more source wirings may be electrically connected to one another. The error electric field can be reduced with a simple configuration by resetting the source wiring potential through the use of a charge sharing function of short-circuiting the adjacent source wirings 3 in the source driver IC 32.

Second Embodiment

Figure 7:
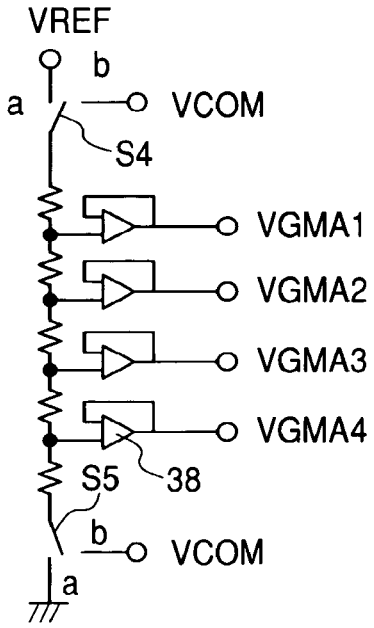
FIG. 7 is a circuit view illustrating the configuration of a control portion according to a second embodiment of the invention.
Figure 8:
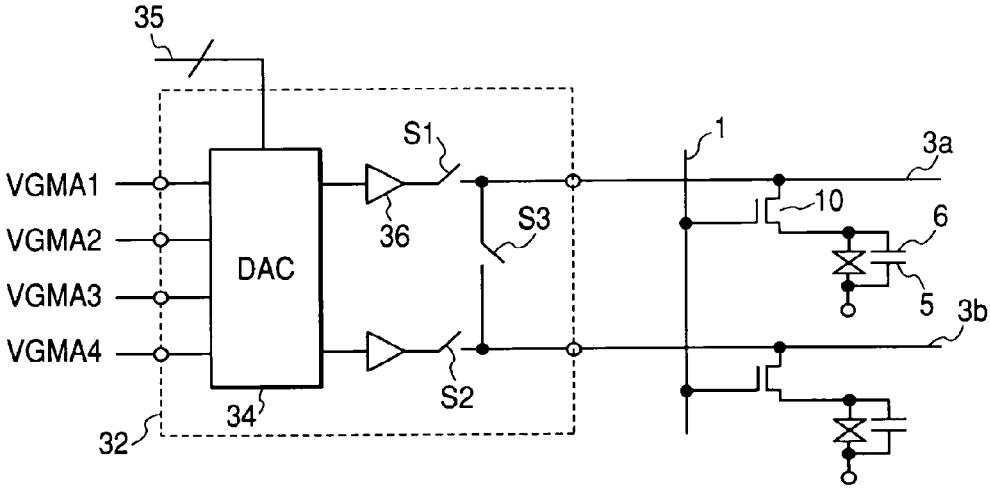
FIG. 8 is a circuit view illustrating the configuration of a driver IC according to the second embodiment of the invention.
Figure 9:
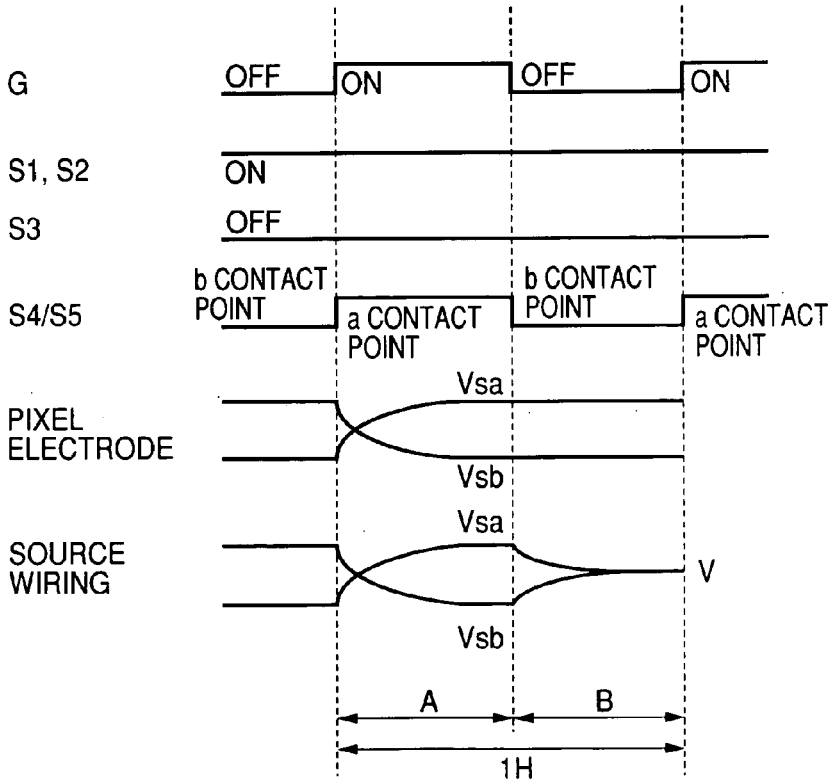
FIG. 9 is a timing chart illustrating signal processing in a liquid crystal display apparatus according to the second embodiment of the invention.

According to this embodiment, the error electric field is reduced by setting the reference voltage, which is used for generating the gradation voltage, to be the common potential $V_{com}$, instead of short-circuiting the adjacent source wirings. The configuration thereof is described by using FIGS. 7 to 9. FIG. 7 is a circuit view showing the configuration of a voltage supply circuit 37 of the control portion 30 according to this embodiment. FIG. 8 is a circuit view showing the configuration of the source driver IC 32 in this embodiment. FIG. 9 is a timing chart showing the scanning signal and the display signal. Incidentally, the description of constituent elements of this embodiment, which are similar to those of the first embodiment, is omitted.

As shown in FIG. 7, a voltage supply circuit 37 for generating the gradation voltage is formed in the control portion 30. The voltage supply circuit 37 is supplied with a reference voltage $V_{ref}$ for generating the gradation voltage. Further, plural resistors are provided between the reference voltage $V_{ref}$ and the ground. An analog voltage to be taken from the plural resistors is determined according to the reference voltage $V_{ref}$ and ratios among the resistances of the resistors. For example, the analog voltage taken from the side of the reference voltage $V_{ref}$ is higher than that taken from the ground side. The analog voltage is amplified by an operational amplifier 38 and obtained as the gradation voltage. This gradation voltage VGMA1 to VGMA4 is inputted to the DA converter of the source driver IC 32. Incidentally, although the four gradation voltages VGMA1 to VGMA4 are shown in FIG. 7, the gradation voltage is not limited thereto. The number of the gradation voltages is determined according to display colors.

In this embodiment, switches S4 and S5 for switching the gradation voltage to the common potential $V_{com}$ are formed at the reference-voltage side and the ground side. For example, at the reference-voltage side, when the switch S4 is in the position of a contact a, the reference voltage $V_{ref}$ is supplied. When the switch S4 is in the position of a contact b, the common potential $V_{com}$ is supplied thereto. At the ground side, when the switch S5 is in the position of the contact a, the ground potential is supplied thereto. When the switch S5 is in the position of the contact b, the common potential $V_{com}$ is supplied thereto. When each of the switches S4 and S5 is in the position of the contact a, the gradation voltages VGMA1 to VGMA4 have predetermined gradation voltage values. On the other hand, when each of the switches S4 and S5 is changed in the position of the contact b, all the voltages VGMA1 to VGMA4 are equal to the common potential $V_{com}$. Thus, the gradation voltage can easily be set at the common potential $V_{com}$ by changing the reference voltage $V_{ref}$ which is used for generating the gradation voltage, to the common potential $V_{com}$ through the use of the switches S4 and S5.

This gradation voltage VGMA1 to VGMA4 is inputted to the DA converter 34 of the source driver IC 32. The source driver IC 32 latches the inputted display data therein in a time sharing manner. Thereafter, the DA (digital-to-analog) conversion thereof is performed in synchronization with a horizontal synchronization signal inputted from the control portion 30. The DA converter 34 generates an analog voltage, which corresponds to the display data inputted from the data line 35, according to the gradation voltage VGMA1 to VGMA4. This analog voltage is amplified by the operational amplifier 36 to thereby obtain the display signal S, which is outputted from the output terminal of the source driver IC 32 to the source wiring 3.

In the write time A, a gate pulse is added to the scanning signal so that the TFT 10 is turned on. Further, in the write time A, the switches S1 and S2 are turned on and only the switch S3 is turned off. Each of the switches S4 and S5 is in the position of the contact a. The reference voltage $V_{ref}$ is supplied to the voltage supply circuit 37 shown in FIG. 7. Thus, the gradation voltages VGMA1 to VGMA4 have predetermined gradation voltage values. Consequently, the pixel potential $V_{sa}$ is inputted to the source wiring 3*a*, while the pixel potential $V_{sb}$ is supplied to the source wiring 3*b*. In the write time A, electric charge is charged to the pixel electrode 6 from the source wiring 3 so that the potential of the pixel electrode 6 is the pixel potential $V_s$. Then, the charging thereof is finished before the gate pulse falls. Thus, the potential of the pixel electrode 6 becomes the pixel potential $V_s$. The pixel electrode 6 is maintained at the potential at the time at which the TFT 10 is turned off, that is, at the pixel potential $V_s$.

On the other hand, in the non-write time B, no gate pulses are added to the scanning signal so that the TFT 10 is turned off. Even in the non-write time B, the switches S1 to S3 are not changed. The switches S1 and S2 remain turned on, and the switch S3 remains turned off. On the other hand, the switches S4 and S5 are changed to the position of the contact b. The common potential $V_{com}$ is supplied to the voltage supply circuit 37 shown in FIG. 7. Thus, all the gradation voltages VGMA1 to VGMA4 are equal to the common potential $V_{com}$. The analog voltage outputted from the DA converter 34 is equal to the common potential $V_{com}$. Therefore, in the non-write time 13, the common potential $V_{com}$ is inputted to the source wiring 3. Thus, the error electric field in the pixels corresponding to the gate wirings 1 other than the gate wiring 1 shown in FIG. 8 can be reduced.

FIG. 9 shows the potentials supplied to the two pixel electrodes and the two source wirings 3 illustrated in FIG. 8. The pixel electrode 6 associated with the source wiring 3*a* holds the potential obtained at the time, at which the gate signal falls in the write time A. Thus, thereafter, the potential of this pixel electrode is the pixel potential $V_{sa}$. In the write time A, the source wiring 3*a* has electric potential being equal to that of this pixel electrode 6. However, in the non-write time B, the common potential $V_{com}$ is supplied to the source wiring 3*a*. Similarly, the pixel electrode 6 associated with the source wiring 3*b* holds the potential obtained at the time, at which the scanning signal falls in the write time A. Thus, thereafter, the potential of this pixel electrode is the pixel potential $V_{sb}$. In the write time A, the source wiring 3*b* has electric potential being equal to that of this pixel electrode 6. However, in the non-write time B, the common potential $V_{com}$ is supplied to the source wiring 3*b*.

In this embodiment, regardless of the pixel potentials $V_{sa}$ and $V_{sb}$ of the pixel electrodes 6, the potential of the source wiring 3 can be set to be the common potential $V_{com}$ in the non-write time B. That is, even when the potential difference between the pixel potential $V_{sa}$ and the common potential $V_{com}$ largely differs form that between the pixel potential $V_{sb}$ and the common potential $V_{com}$, the potential of the source wiring 3 can be set to be the common potential $V_{com}$ in the non-write time B. Thus, the error electric field can effectively be reduced still more. Consequently, the quality of display can be enhanced. The aperture rate can be enhanced still more. Needless to say, in a case where the potential, to which the potential to be supplied is changed in the voltage supply circuit 37, is close to the common potential $V_{com}$, the error electric field can be reduced.

The gradation voltage can be set at the common potential $V_{com}$ with a simple configuration by providing the switches S4 and S5, which are used for switching the reference voltage $V_{ref}$ to the common potential $V_{com}$, in the voltage supply circuit 37 of the control portion 30. Such signal processing can prevent the error electric field from disturbing the orientation of the liquid crystals and from causing defective display. Thus, the restriction on the aperture rate is alleviated. The aperture rate can be enhanced. Thus, a liquid crystal display apparatus of a simple configuration, which has high quality of display and a high aperture rate, can be provided by controlling the voltage supply circuit, which is used for generating the gradation voltage, in this manner. Incidentally, the switches S4 and S5 of the voltage supply circuit 37 are not limited to those adapted to switch the reference voltage $V_{ref}$ to the common potential $V_{com}$, switches enabled to switch the reference voltage $V_{ref}$ to an electric potential being close to the common potential $V_{com}$ may be used. The source wiring potential can be reset with a simple configuration by controlling the gradation voltage supplied to the source driver IC 32 in this way.

The configuration for supplying the common potential $V_{com}$ or the electric potential, which is closer to the common potential $V_{com}$ than the pixel potential $V_s$, to the source wiring 3 in the non-write time B is not limited to the aforementioned configuration. Moreover, the configuration of a pixel is not limited to the aforementioned configuration thereof, and can be applied to a liquid crystal display apparatus in which an error electric field is generated between the pixel electrode 6 and the source wiring 3 thereof when the writing is performed on another pixel.

Although the write time A and the non-write time B are assumed to be nearly equal in length, one of the times A and B may be longer than the other. Additionally, the times A and B may be adapted so that the first half of one horizontal period is the non-write time B, and that the second half thereof is the write time A. Furthermore, one horizontal period may include two or more of the write time A or of the non-write time B.

Third Embodiment

Figure 10:
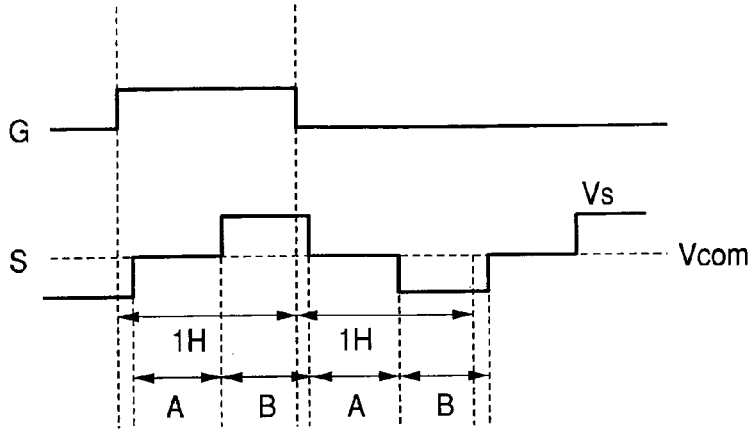
FIG. 10 is a timing chart illustrating signal processing in a liquid crystal display apparatus according to a third embodiment of the invention.
Figure 11A:
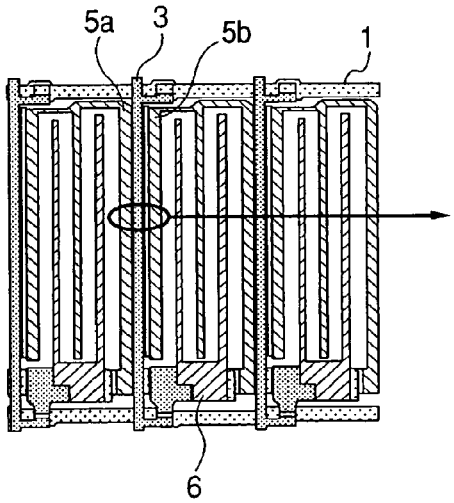
FIGS. 11A and 11B are views illustrating the configuration of a pixel in a conventional IPS liquid crystal display apparatus.
Figure 11B:
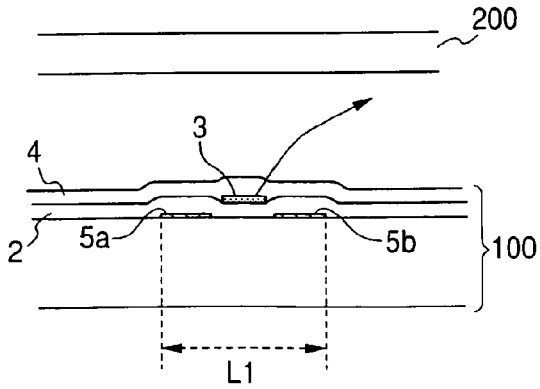
CONVENTIONAL ART FIG. 11B

Signal processing performed in a liquid crystal-display apparatus according to this embodiment is described by using FIG. 10. FIG. 10 is a timing chart showing the signal processing performed in the liquid crystal display apparatus according to this embodiment. This embodiment differs from the aforementioned embodiments in the scanning signal G and the display signal S. The description of constituent elements of the third embodiment, which are similar to those of the first embodiment and the second embodiment, is omitted.

In the third embodiment, a positive gate pulse, whose duration is one horizontal period, is used as a gate signal G. That is, a gate pulse having a duration, which is the one horizontal period, is applied to the gate wiring 1. The time A and the time B are present corresponding to the one horizontal period in the source signal S. This time B is present subsequent to the time A and includes the time at which the gate pulse falls. That is, in the time B, the level of the gate signal G changes a positive level to 0. Therefore, in the time B, the state of the TFT changes from an ON-state to an OFF-state. On the other hand, in the time A, the TFT remains turned on. In this embodiment, the time B is the write time, while the time A is the non-write time. A total of the time A and the time B corresponds to the one horizontal period. The set of the time A and the time B slightly lags a time period in which the level of the gate pulse is positive. The time A and the time B are substantially equal in length.

In the time A, the common potential $V_{com}$ or a potential being closer to the common potential $V_{com}$ than the pixel potential $V_s$ is supplied to the source signal S. A method of supplying the common potential $V_{com}$ or a potential being closer to the common potential $V_{com}$ than the pixel potential $V_s$ is similar to those employed in the first embodiment or the second embodiment. Thus, the description of this method is omitted. In a state in which the TFT is turned on, a time period, in which the signal processing is performed, is shifted from the time A to the time B. In the time B including the time, at which the state of the TFT is changed from the ON-state to the Off-state, the source signal S is supplied with the associated pixel potential $V_s$. During the pixel potential $V_s$ is supplied to the source wiring 3, the state of the TFT is changed from the ON-state to the Off-state. Thus, the pixel electrode is held at the pixel potential $V_s$. That is, in the write time B, electric charge is charged from the source wire 3 to the pixel electrode 6 so that the potential of the pixel electrode 6 becomes the pixel potential $V_s$. Then, the charging thereof is finished before the gate pulse falls. Thus, the potential of the pixel electrode 6 becomes the pixel potential $V_s$. The pixel electrode 6 is maintained at the potential at the time at which the TFT 10 is turned off. Consequently, the pixel electrode 6 is held at the pixel potential $V_s$, so that accurate display can be performed.

In the time A, which is the non-write time, the common potential $V_{com}$ is inputted to the source wiring 3. Thus, the error electric field can be reduced. Incidentally, in this embodiment, the time, at which the state of the TFT is changed from the OFF-state to the ON-state, may be included in the time A. Additionally, the duration of the time B is determined in such a way as to include the time at which the charging of the pixel electrode to the pixel potential is finished.

The invention claimed is:

1. A liquid crystal display apparatus comprising:

plural gate wirings formed on a substrate;

source wirings intersecting with the gate wirings through an insulating film;

switching elements connected to the source wirings;

pixel electrodes connected to the source wirings through the switching elements, to which pixel potentials are inputted according to a driving voltage for driving liquid crystals; and common electrodes, disposed opposite to the pixel electrodes and adapted so that a common potential is inputted thereto, a voltage supply circuit includes a plurality of resistors connected to the source wiring and is configured to have a plurality of voltage outputs and at least two switched states; and a driving circuit for inputting the pixel potentials to the source wirings according to a gradation voltage, wherein a scanning signal is inputted to the gate wirings so that one horizontal period of the liquid crystal display apparatus has a write time, in which the pixel potential is written to the pixel electrode, and a non-write time in which the pixel potential is not written to the pixel electrode, wherein the pixel potential is inputted to the source wiring in the write time, and an electric potential being closer to the common potential than the pixel potential is inputted to the source wiring in the non-write time, wherein in a first switched state during the write time, the voltage supply circuit is configured to generate an analog voltage based on a reference voltage and ratios among the plurality of resistors and supply a plurality of gradation voltages to the driving circuit according to a supplied reference voltage and resistances of the plurality of resistors, the pixel potential being generated based on the analog voltage of the voltage supply circuit, wherein in a second switched state the voltage supply circuit provides on each of the plurality of outputs the electric potential, which is closer to the common potential than the pixel potential, wherein each gradation voltage is associated with a respective combination of resistances of the plurality of resistors, and wherein the liquid crystal display apparatus is an in-plane switching liquid crystal display apparatus, which drives liquid crystals horizontally to the substrate according to an electric field generated by the pixel potential of the pixel electrode and the common potential of the common electrode.

2. The liquid crystal display apparatus according to claim 1, wherein an electric potential being substantially equal to the common potential is inputted to the source wiring in the non-write time.

3. The liquid crystal display apparatus according to claim 1, wherein the source wirings, the pixel electrodes, and the common electrodes are connected to a central portion, and wherein the source wirings, the pixel electrodes, and the common electrodes are bent at the central portion.

4. The liquid crystal display apparatus according to claim 1, wherein a number of the plurality of voltage outputs available is determined based on a color to be displayed.

5. The liquid crystal display apparatus according to claim 1, wherein the voltage supply circuit includes an operational amplifier that amplifies the analog voltage to provide a gradation voltage.

6. A driving method for a liquid crystal display apparatus comprising: plural gate wirings formed on a substrate; source wirings intersecting with the gate wirings through an insulating film; switching elements connected to the source wirings; pixel electrodes connected to the source wirings through the switching elements, to which pixel potentials are inputted according to a driving voltage for driving liquid crystals; common electrodes, disposed opposite to the pixel electrodes and adapted so that a common potential is inputted thereto, and a voltage supply circuit that includes a plurality of resistors connected to the source wiring and is configured to have a plurality of voltage outputs and at least two switched states, the method comprising the steps of:

supplying a scanning signal to the gate wirings in such a way as to form a write time, in which a pixel potential is written to the pixel electrode, in one horizontal period;

inputting the pixel potential to the source wirings in the write time;

supplying a scanning signal to the gate wrings so that the one horizontal period has a non-write time in which the pixel potential is not written thereto; and inputting an electric potential being closer to the common potential than the pixel potential to the source wirings in the non-write time, wherein in a first switched state during the one horizontal period, supplying the pixel potential supplied to the source wirings is based on an analog voltage generated in the voltage supply circuit using a reference voltage and resistance ratios among the plurality of resistors, wherein liquid crystals are driven horizontally to the substrate according to an electric field generated by the pixel potential of the pixel electrode and the common potential of the common electrode, wherein, in the first switched state, a first switch is conducted to a reference-voltage side and a second switch is conducted to a ground side, and wherein, in a second switched state, both of the first switch and the second switch are conducted to the electric potential closer to the common potential.

7. The driving method for a liquid crystal display apparatus according to claim 6, wherein an electric potential being substantially equal to the common potential is inputted to the source wirings in the non-write time.

8. The driving method for a liquid crystal display apparatus according to claim 6, wherein the voltage supply circuit includes an operational amplifier, the method comprising:

amplifying the analog voltage generated from the reference voltage and resistance ratios to provide a gradation voltage.

9. A liquid crystal display apparatus comprising:

plural gate wirings formed on a substrate;

source wirings intersecting with the gate wirings through an insulating film;

switching elements connected to the source wirings;

pixel electrodes connected to the source wirings through the switching elements, to which pixel potentials are inputted according to a driving voltage for driving liquid crystals;

common electrodes, disposed opposite to the pixel electrodes and adapted so that a common potential is inputted thereto; and a voltage supply circuit having a plurality of resistors connected to the source wiring and is configured to have a plurality of voltage outputs and at least two switched states, wherein a time period corresponding to one horizontal period of the liquid crystal display apparatus includes a first time including a moment at which a state of the switching element changes from an ON-state to an Off-state and a second time that is present in such a way as to be precedent to the first time, wherein the pixel potential is inputted to the source wirings in the first time, and wherein an electric potential being closer to the common potential than the pixel potential is inputted to the source wirings in the second time, wherein in a first switched state at the first time, the voltage supply circuit is configured to generate an analog voltage based on a reference voltage and ratios among the plurality of resistors, the pixel potentials being generated based on the analog voltage of the voltage supply circuit, wherein liquid crystals are driven horizontally to the substrate according to an electric field generated by the pixel potential of the pixel electrode and the common potential of the common electrode, wherein the voltage supply circuit includes a first switch connected at a reference-voltage side and a second switch connected at a ground side, the first and second switches being connected to switch the electric potential closer to the common potential, and wherein the at least two switched states are caused by switching the first switch and the second switch between ON and OFF states.

10. The liquid crystal display apparatus according to claim 9, wherein the source wirings, the pixel electrodes, and the common electrodes are connected to a central portion, and wherein the source wirings, the pixel electrodes, and the common electrodes are bent at the central portion.

11. The liquid crystal display apparatus according to claim 9, wherein the voltage supply circuit includes an operational amplifier that amplifies the analog voltage to provide a gradation voltage.

12. A driving method for a liquid crystal display apparatus comprising: plural gate wirings formed on a substrate; source wirings intersecting with the gate wirings through an insulating film; switching elements connected to the source wirings; pixel electrodes connected to the source wirings through the switching elements, to which pixel potentials are inputted according to a driving voltage for driving liquid crystals; common electrodes, disposed opposite to the pixel electrodes and adapted so that a common potential is inputted thereto, and a voltage supply circuit that includes a plurality of resistors connected to the source wiring and is configured to have a plurality of voltage outputs and at least two switched states, the method comprising the steps of:

inputting an electric potential being closer to the common potential than the pixel potential to the source wirings in a time period corresponding to one horizontal period of the liquid crystal display apparatus;

supplying the pixel potential to a pixel electrode until the switching element changes from an ON-state to an OFF-state, wherein the pixel potential is a second pixel potential supplied after a first pixel potential that is closer to the common potential than the second pixel potential is supplied to the source wirings, wherein in a first switched state of the voltage supply circuit during the one horizontal period, supplying the pixel potentials to the source wirings is based on an analog voltage generated in the voltage supply circuit using a reference voltage and resistance ratios among the plurality of resistors, and wherein the liquid crystal display apparatus is an in-plane switching liquid crystal display apparatus, which drives liquid crystals horizontally to the substrate according to an electric field generated by the pixel potential of the pixel electrode and the common potential of the common electrode, wherein, in the first switched state, a first switch is conducted to a reference-voltage side and a second switch is conducted to a ground side, and wherein, in a second switched state, both of the first switch and the second switch are conducted to the electric potential closer to the common potential.

13. The driving method for a liquid crystal display apparatus according to claim 12, wherein the voltage supply circuit includes an operational amplifier, the method comprising:

amplifying the analog voltage generated from the reference voltage and resistance ratios to provide a gradation voltage.

14. A liquid crystal display apparatus comprising:

plural gate wirings formed on a substrate;

source wirings intersecting with the gate wirings through an insulating film;

switching elements connected to the source wirings;

pixel electrodes connected to the source wirings through the switching elements, to which pixel potentials are inputted according to a driving voltage for driving liquid crystals; and common electrodes, disposed opposite to the pixel electrodes and adapted so that a common potential is inputted thereto, a voltage supply circuit includes a plurality of resistors connected to the source wiring and is configured to have a plurality of voltage outputs and at least two switched states;

wherein a scanning signal is inputted to the gate wirings so that one horizontal period of the liquid crystal display apparatus has a write time, in which the pixel potential is written to the pixel electrode, and a non-write time in which the pixel potential is not written to the pixel electrode, wherein the pixel potential is inputted to the source wiring in the write time, and an electric potential being closer to the common potential than the pixel potential is inputted to the source wiring in the non-write time, wherein in a first switched state during the write time, the voltage supply circuit is configured to generate an analog voltage based on a reference voltage and ratios among the plurality of resistors, the pixel potential being generated based on the analog voltage of the voltage supply circuit, wherein the liquid crystal display apparatus is an in-plane switching liquid crystal display apparatus, which drives liquid crystals horizontally to the substrate according to an electric field generated by the pixel potential of the pixel electrode and the common potential of the common electrode, wherein the voltage supply circuit includes a first switch connected at a reference-voltage side and a second switch connected at a ground side, the first and second switches being connected to switch the electric potential closer to the common potential, and wherein the at least two switched states are caused by switching the first switch and the second switch between ON and OFF states.

* * * * *